United States Patent [19]

Lawrence, Jr.

[11] 4,016,827

[45] Apr. 12, 1977

[54] MAGNETICALLY COUPLED INDICATOR MEANS FOR CONTROL SETTING

[76] Inventor: James F. Lawrence, Jr., 13161 Barrett Hill Circle, Santa Ana, Calif. 92705

[22] Filed: Sept. 12, 1975

[21] Appl. No.: 612,930

[52] U.S. Cl. ..... 116/129 D; 116/124 A; 338/196

[51] Int. Cl.[2] ..... H01C 1/01

[58] Field of Search ..... 116/129 D, 129 B, 124 R, 116/124 A, 129 R, 117 A; 340/282, 336; 338/196, 317; 73/431

[56] References Cited

UNITED STATES PATENTS 1,033,610 7/1912 Nash ..... 116/117 A

*Primary Examiner*—Richard C. Queisser
*Assistant Examiner*—Daniel M. Yasich
*Attorney, Agent, or Firm*—Forrest J. Lilly

[57] ABSTRACT

A magnetized pointer in conjunction with a dial scale affixed to a supporting panel, on the opposite side of which is located a rotary device such as a potentiometer, to the shaft of which is attached a magnet, the poles of which will cause the opposite poles of the magnetized pointer to follow and indicate the degree of rotation, without the need of mechanical coupling.

2 Claims, 4 Drawing Figures

MAGNETICALLY COUPLED INDICATOR MEANS FOR CONTROL SETTING

BACKGROUND OF THE INVENTION

1. Field of the Invention

This invention relates generally to indicating dials for indicating the degree of position of rotation of rotating or mechanically adjustable shafts used in conjunction with electronic controls or other rotating devices. The invention is useful for indicating the position of a rotary device located within a totally enclosed vessel of non-magnetic material where mechanical coupling to an indicator outside is not possible.

2. Description of Prior Art

It is common practice in the construction of electronic equipment to recess control shafts behind equipment panels and to provide a screwdriver access hole in the panel for insertion of a screwdriver in a slot in the end of the shaft for rotation. This eliminates control knobs from the front panel where they can be turned accidentally or unnecessarily. The disadvantage of the recessed control shaft is the lack of a suitable rotation pointer and indicator dial for reference in setting or resetting the control. The primary purpose of the present invention is to provide a simple and accurate indication of the control setting.

BRIEF DESCRIPTION OF THE INVENTION

Magnets are attached to and extend radially from the shaft whose rotational position is to be determined. As the shaft is rotated the lines of magnetic flux extending between the north and south poles of the magnets link similar lines of force from a magnetic pointer in near proximity within a dial indicator housing placed on a front instrument panel, in front of the rotating shaft and magnets. Since dissimilar poles of a magnet are attracted, the north magnetic pole of the pointer will align with the south magnetic pole of the magnet attached to the shaft, as will the other opposite poles. The pointer will be aligned with the rotating magnet at all times. A hole is placed coaxially through the indicator and panel to provide access to the slotted shaft. The invention may be used to transmit rotational information to an indicator where mechanical linkage is not possible, such as through the wall of a pressure vessel constructed of non-magnetic material.

DETAILED DESCRIPTION OF AN ILLUSTRATIVE EMBODIMENT

Figure 1:
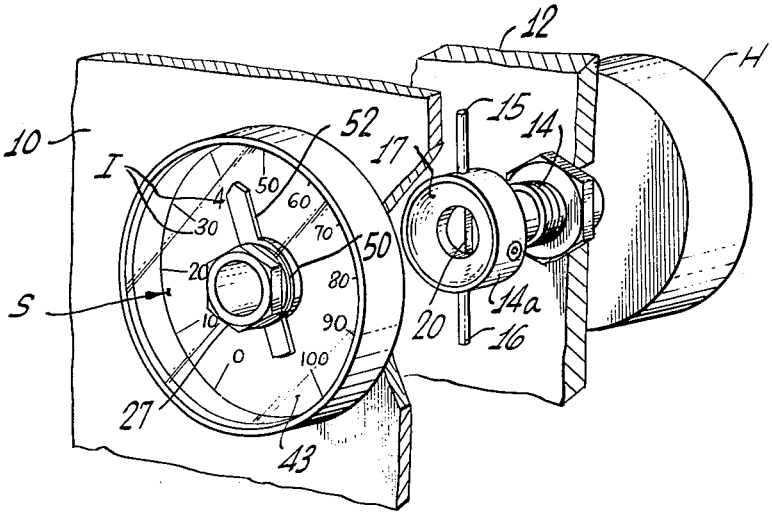
FIG. 1 is a partially broken away perspective view of an illustrative embodiment of the invention.
Figure 2:
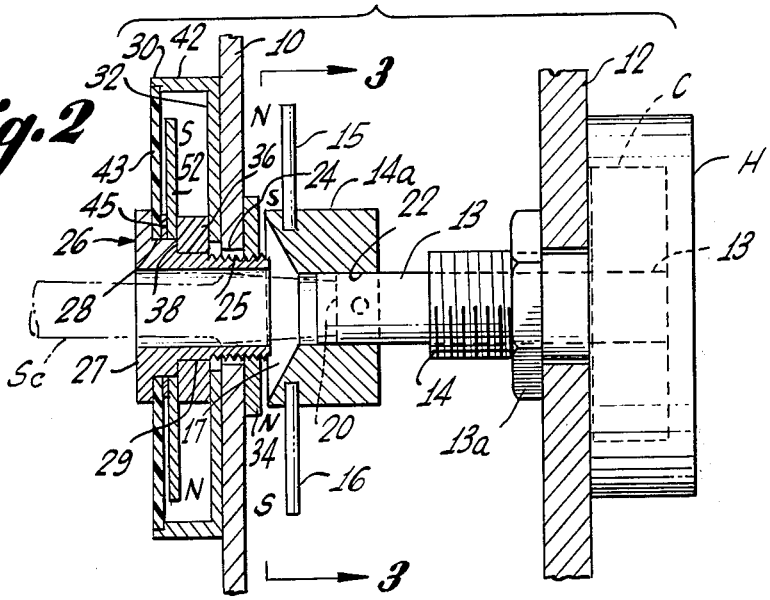
FIG. 2 is a longitudinal vertical sectional view through the illustrative embodiment seen in FIG. 1.
Figure 3:
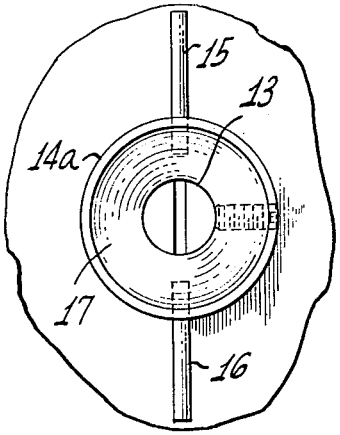
FIG. 3 is a view taken in accordance with line 3—3 of FIG. 2.
Figure 4:
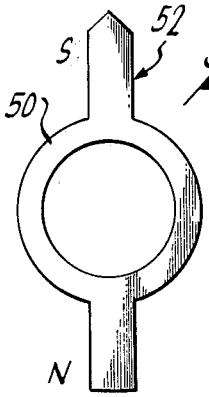
FIG. 4 is a detail front view of the magnetized position indicator.

In the drawings, a non-magnetic (dielectric) usually vertical front panel of an instrument enclosure is designated at 10.

Spaced behind this panel 10 is a mounting panel 12 for an electrical adjustment or control device C, such, for example, as a rotary shaft controlled variable resistor, potentiometer, inductor, capacitor, or the like, whose housing is designated at H mounted to the rearward side of the panel 12. The rotatable shaft 13 for the control device C is rotatably mounted in a bushing 14 extending through panel 12, and tightened in a conventional manner by a jamb nut **13*a*, and this shaft will be understood to rotate a rotor of the control C, such as a contact arm of a variable potentiometer. Details of the control device C are not shown, since the control device may be of any type, capable of adjustment or regulation by a rotatable wiper arm or other rotor turned by shaft 13**.

On the front end of the shaft 13 is set a collar **14*a*, preferably of magnetic material, which bears two oppositely radially extending bar magnets 15 and 16, the outermost extremities of which have opposite polarities, N and S. The collar 14*a* has formed in its front end a conical mouth 17 leading to an axial bore 22 into which the forward end portion of shaft 13 is received; and the front extremity of shaft 13 has a screwdriver slot 20** for the blade of a screwdriver S*c* indicated in working position in phantom lines.

Panel 10 has, in axial alignment with rotor shaft 13, a bore 24 which receives a threaded inner extent 25 of a bushing 26, the latter having a hex head 27, a reduced cylindrical portion 28, and a further reduced cylindrical portion 29, the latter leading to threaded portion 25.

A dial housing 30 has a round back wall 32, abutting and suitably fastened against non-magnetic panel 10, and may be composed of non-magnetic material such as aluminum or a suitable plastics substance. A nut 34 screwed into the threaded portion of bushing 26 draws housing wall 32 toward panel 10, and is set up against the latter. A washer 36 engages the front surface of housing back wall 32, and is engaged by the annular shoulder 38 at the junction of cylindrical bushing portions 28 and 29. Thus the dial housing wall 32 is held against panel 10 through washer 36 and bushing 26 through setting up of nut 34.

Dial housing 30 includes a cylindrical side wall 42 rabbetted to receive the edge of a transparent front glass or clear plastic plate 43, and the hex head 27 of the bushing 26 just nicely abuts this plate 43 when the nut 32 is screwed tightly onto the bushing.

A washer 45 is placed on bushing portion 28 in back of transparent plate 43, and a flat central ring portion 50 of a magnetic indicator or pointer 52 is freely rotatable on cylindrical bushing portion 28, between washers 36 and 45. The pointer is magnetized so as to have a North pole near one extremity and a South pole near the other. These poles are related magnetically in a predetermined manner to the polarities of the outer extremities of the magnetized bars 15 and 16, such that a magnetic flux path from the outer extremity of one of magnets 15 and 16 extends in a loop intercepting the magnetized pointer or indicator 52 and returns to the outer extremity of the other of magnets 15 and 16. The magnetized pointer or indicator 52 thus linked into the magnetic circuit, indicator 52 must then line up with this flux path or loop. Having done this, the pointer indicates the position of the magnets 15 and 16 and shaft 13, and thus in turn indicates the exact circumferential position of shaft 13 and of the hidden control rotor of control C. This exact position may be read from the scale indicia I inscribed on a scale or dial S affixed to the front face of the housing wall 36. Or, the scale could of course be located on the panel 10, around the periphery of the housing 30, or even on the peripheral wall 42 of the housing.

Several variations are possible in the makeup of the magnetic circuit. First, the two bar magnets 15 and 16 may each be magnetized, and have North and South poles at their ends. They will then be so arranged that the outer extremity of one magnet will have a North pole, and the outer extremity of the second magnet will then have a South pole. The collar 14*a* may then be of magnetic material, to continue the magnetic circuit through magnetic material. It would be possible, however, to make the collar of non-magnetic material, or of a material having relatively high reluctance, in which case the magnetic path between the near ends of the bar magnets will be of considerably greater reluctance — but the resulting higher reluctance gap can be used as a part of the circuit.

In service, the blade of a screwdriver is inserted through the bore of bushing 26 and engaged with the screwdriver slot 20 in the end of shaft 13. The shaft may then be turned by the screwdriver to an angular position indicated to the operator by the position assumed by the indicator 52 owing to its magnetic coupling to the adjustment or regulator shaft 13.

Various changes may of course be made in the particular embodiment chosen for specific disclosure herein without departing from the scope of the invention, and are to be fairly encompassed within the scope of the invention.

What is claimed is:

1. In a magnetically coupled dial and pointer indicator adapted to reveal the rotary position of an instrument circuit control rotor concealed inside an instrument vessel mounted on a support and controlled in position by a rotatably adjustable shaft extending through a wall of the vessel, bar magnet means fixed on an end portion of said shaft, exteriorly of said vessel, said bar magnet means extending generally radially from opposite sides of said shaft and having outer extremities of respectively opposite polarity, said bar magnet means being configured and oriented to have a magnetic circuit producing a magnetic flux loop extending between said extremities and having an intermediate region thereof extending substantially unidirectionally transversely across the prolonged axis of said shaft, generally perpendicularly thereto, a non-magnetic indicator housing for said pointer indicator spacedly fixed with respect to said instrument vessel, with a back, and a transparent cover, said housing being positioned with its back facing said end portion of said shaft, said housing being so positioned relatively to said end portion of said shaft and said extremities of said bar magnet means that said intermediate region of said flux loop is substantially contained inside said housing, said pointer indicator comprising a longitudinally magnetized pointer in said housing, means on said housing mounting said pointer to rotate freely on an axis generally aligned with said shaft, and in a plane generally perpendicular to such axis, within said intermediate region of said flux loop, a fixed calibrated scale associated with said housing and cooperable with said pointer; and said pointer and housing having a passageway therethrough, aligned with said shaft, to provide for extending a tool therethrough to engage and rotate said shaft.

2. The indicator of claim 1, including also a supporting wall for said pointer housing, adapted to support said housing from the back, said passageway being defined by a hollow bushing coaxial with said shaft and extending through said pointer housing and said last-mentioned mounting wall and supporting said housing on said wall, and said pointer having a central ring portion freely rotatably mounted on a cylindrical portion of said bushing inside said housing.

* * * * *